US005349710A

United States Patent [19]

Dunn

[11] Patent Number: 5,349,710

[45] Date of Patent: Sep. 27, 1994

[54] FLEXIBLE BAG RETAINING DEVICE

[76] Inventor: William P. Dunn, 801 N. Pitt St. Apt. 206, Alexandria, Va. 22314

[21] Appl. No.: 961,414

[22] Filed: Oct. 15, 1992

[51] Int. Cl.[5] ..... B65B 67/00

[52] U.S. Cl. ..... 5/503.1; 248/99; 248/95

[58] Field of Search ..... 248/95, 99, 101, 100; 220/404; 383/6, 12, 13, 22; 5/503.1, 504.1, 505.1, 506.1, 507.1; 604/277, 317, 334

[56] References Cited

U.S. PATENT DOCUMENTS 1,422,524 7/1922 Beal et al. .
2,701,883 2/1955 DeFazio, J. ..... 5/317
2,784,423 3/1957 Droeger et al. ..... 5/317
3,138,361 6/1964 Meldrum ..... 248/95
3,321,103 5/1967 Phillips ..... 220/404
3,920,179 11/1975 Hall ..... 604/317
4,141,524 2/1979 Corvese, Jr. ..... 5/503.1
4,235,350 11/1980 Valentino ..... 220/404
4,483,501 11/1984 Eddy ..... 248/205
4,488,697 12/1984 Garvey ..... 248/101
4,686,727 8/1987 Wilkinson ..... 5/503.1
4,773,768 9/1988 Leeper ..... 383/22
4,904,234 2/1990 Yaniv et al. ..... 248/100
4,919,546 4/1990 Imazeki et al. ..... 248/99
4,998,700 3/1991 McKaig ..... 5/503.1
5,038,434 8/1991 Navarrette ..... 5/507

*Primary Examiner*—Eugenia Jones
*Assistant Examiner*—Allan M. Schrock

[57] ABSTRACT

A device is provided for convenient retention of a disposable, flexible, plastic waste bag for use in various medical procedures. The bag retaining device includes a liquid reservoir and an aperture in communication with the bag. A series of grippers maintains the bag under a mattress or the like to hold it in a secure posture and prevent it from becoming dislodged if accidentally struck.

9 Claims, 2 Drawing Sheets

FLEXIBLE BAG RETAINING DEVICE

BACKGROUND OF THE INVENTION

1. Field of the Invention

The invention herein pertains to medical devices and particularly to a device for retaining a disposable waste container for use during certain medical procedures at the bedside of a patient.

2. Descrption of the Prior Art and Objectives of the Invention

Medical and hospital personnel attitudes have rapidly changed in recent years concerning the use of disposable instruments and supplies to increase the usage of throw-away items in order to save time, money and provide additional safety to both patients and medical employees. With the spread of fatal viral diseases in recent years more emphasis has been placed on the protection of employees and patients to prevent further spread through physical contact with body fluids and instruments. For many patients it is necessary to relieve them of certain body fluids by the use of suction devices and flexible tubing. In other invasive procedures instruments must be kept clean and sterile during intermittent use. Distilled water is also commonly used at the bedside in various medical procedures and requires careful attention during employment. In certain oral and airway procedures, tools and supplies, when removed from the patient have to be held in a sterile container for use again during the procedure. Tubing along with bandages, rubber gloves and the like, after use must be quickly and safely contained and disposal made without undue handling by attending medical personnel.

Thus, with the new required precautions in the procedures as outlined above it is an objective of present invention to provide a temporary flexible bag retaining device which can be conveniently used as needed at a patient's bedside or table for holding instruments, waste liquids, materials or the like.

It is another objective of the present invention to provide one embodiment of a bag retaining device which includes a releasable ring for quick removal and replacement of the bag as necessary.

It is still another objective of the present invention to provide a combination flexible bag retaining device with a permanently affixed disposable plastic bag which can be conveniently used and safely disposed.

It is also an objective of the present invention to provide a flexible bag retaining device which includes a liquid reservoir and means to hold a plurality of plastic tubes for easy access during use before disposal.

It is yet still another objective of the present invention to provide a flexible bag retaining device which includes an elongated member having a series of gripping elements to maintain the bag in a secure posture beneath the mattress of a bed.

Various other advantages of the present invention become apparent to those skilled in the art as a more detailed description is set forth below.

SUMMARY OF THE INVENTION

The aforesaid and other objectives are realized by providing a flexible bag retaining device for partial placement beneath a bed or examining table mattress of a patient which includes an elongated member having an aperture at one end thereof with a depending flange for attachment within the mouth of an attached plastic bag. The bag is held against the flange by the use of a retaining ring which slips over the bag and surrounds the flange. The aperture allows access to the bag by forming a rim around the mouth of the bag. At the opposite end of the elongated member a series of grippers are provided which stabilize the device during use and prevent it from accidentally dislodging from beneath the mattress. A liquid reservoir proximate the aperture allows distilled water to be conveniently available for use during required medical procedures. One inexpensive throw-away embodiment may include a flexible bag permanently affixed thereto with a snap-on cap or cover attached to the elongated member to securely close the bag prior to disposal of the retaining device and bag.

DETAILED DESCRIPTION OF THE PREFERRED EMBODIMENT AND OPERATION OF THE INVENTION

Figure 1:
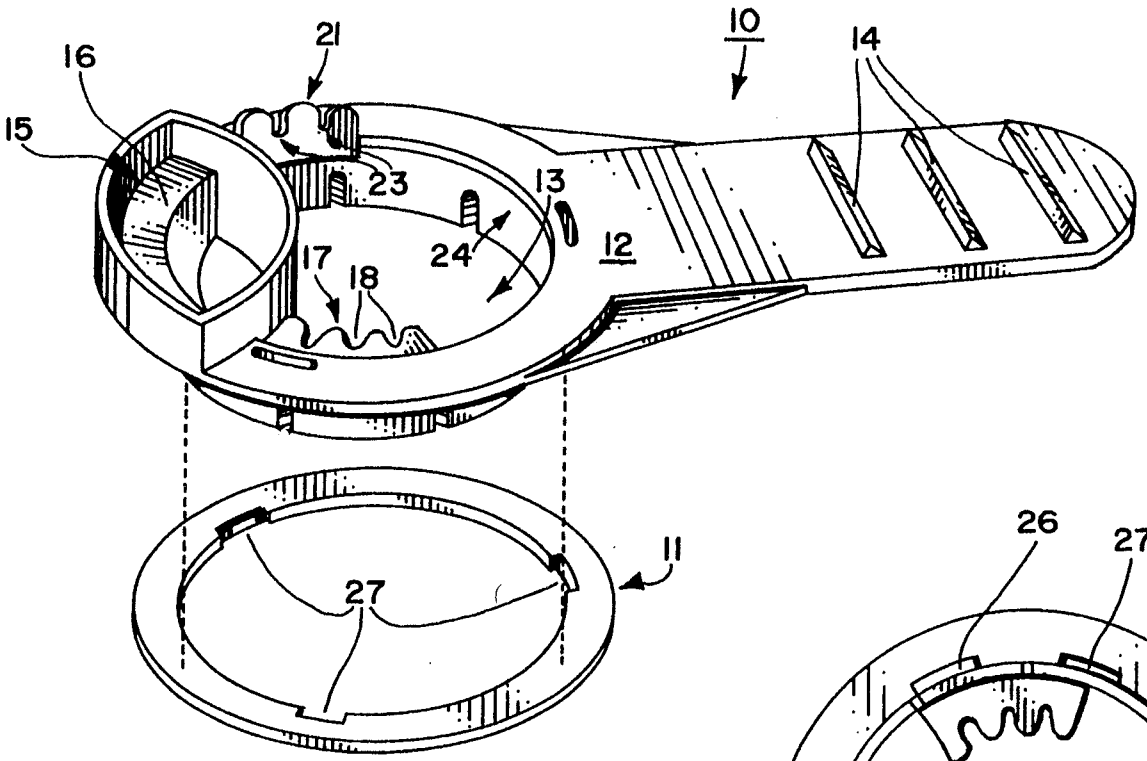
FIG. 1 shows a top perspective view of a flexible bag retaining device of the invention.

For a better understanding of the invention, turning now to the drawings, FIG. 1 shows a top perspective view of the preferred embodiment of flexible bag retaining device 10 with retaining ring 11 removed therefrom. Retaining device 10 includes an elongated member 12 which defines an aperture 13 on one end thereof and on the other provides a series of means 14 to grip a mattress or the like to stabilize retaining device 10 as will be hereinafter explained in more detail. Elongated member 12 may be formed or molded from any suitable material such as rigid plastic and may be for example, approximately one-eighth of an inch thick. Gripping means 14 may each be for example, two and three eighths inches long and extend upwardly from elongated member 12 approximately one-quarter of an inch. Proximate aperture 13, at the end of elongated member 12 is a liquid, reservoir 15 for containing pure distilled water which can be useful in various medical procedures such as to clean instruments, moisten tubes or the like. Liquid reservoir 15 may contain one to two liquid ounces and is a bi-level container with step 16 providing a platform four resting needles or other tools thereon for easy retrieval yet be kept within the water or liquid if desired. As would be understood retaining device 10 may be sanitized or sterilized prior to use, depending on its particular employment and the medical procedure undertaken.

Figure 5:
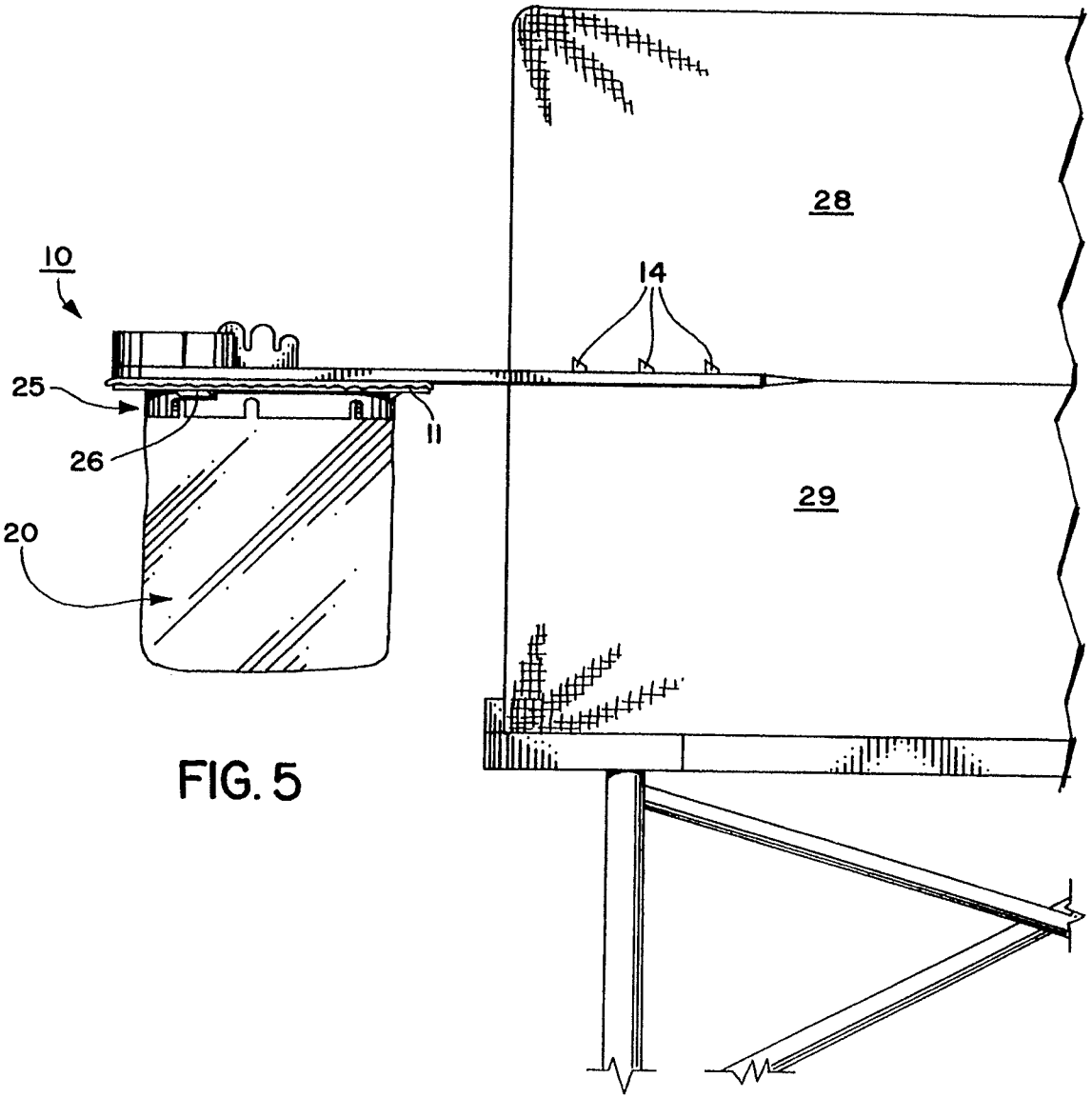
FIG. 5 pictures the flexible bag retaining device in position for use beneath a mattress.
Figure 2:
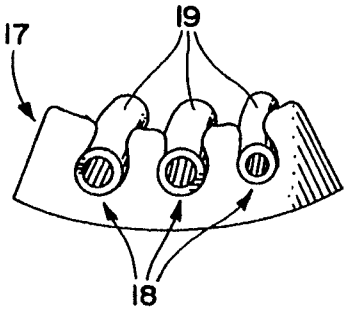
FIG. 2 depicts an enlarged view of the mechanism to hold typical flexible tubes in an open configuration.

As flexible suction tubes, drain tubes and other conduits are commonly used with many hospital and medical procedures, tube catch 17 is readily available as shown positioned on the inner edge of aperture 13 in FIG. 1 to accommodate various size flexible tubings. Tube catch 17 includes a plurality of slots 18 as shown in FIG. 2 for engaging flexible tubes 19. As seen, flexbile tubes 19 are not crimped or closed when situated within catch 17 but remain open to allow liquid to drain into transparent flexible polyethylene bag 20 is shown in FIG. 5. Other types of bags could be employed but polyethylene is preferred as being inexpensive, durable and easily obtained. Body fluids of various types including blood or mucus or excess or contaminated pharmaceutical solutions can be drained through flexible tubes 19 into bag 20 whereafter bag 20 can be easily disposed. A "snap-on" or other cap or cover (not shown) may be affixed to elongated member 12 to close bag 20 and prevent the spread oil bacteria during and after disposal.

Figure 3:
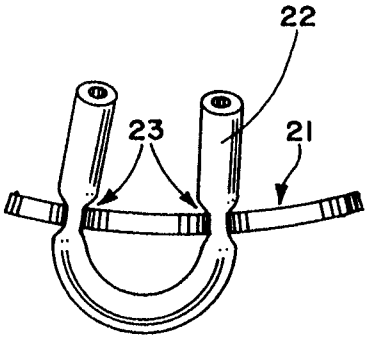
FIG. 3 demonstrates an enlarged view of apparatus to pinch or close a flexible tube.

Oftentimes during medical procedures a suction or other tube is employed which may require temporary closing. In order to free the hands of the nurse or other medical personnel during the procedure, means 21 is provided as shown in FIG. 3 which will allow placement a flexible tube therein to "pinch" or close the tube when in place. As seen in FIG. 3, flexible tube 22 is retained within narrow slots or grooves 23 to maintain tube 22 in a closed posture.

Figure 4:
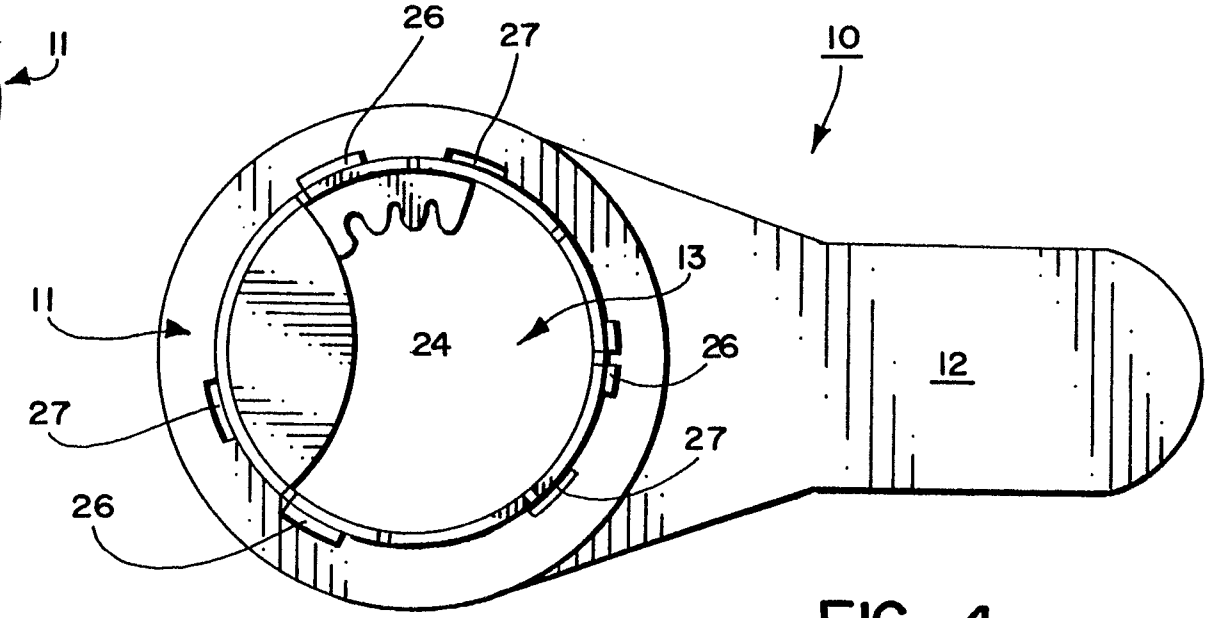
FIG. 4 illustrates a bottom view of the bag retaining device.

Flexible bag retaining device 10 may be used in a variety of hospital and medical procedures and one of its components is the convenient, easily removable, replaceable, flexible disposable polyethylene bag 20. As shown in FIG. 4, a downwardly extending flange 24 is attached proximate the periphery of aperture 13 of elongated member 12 for receiving mouth 25 of flexible bag 20 (FIG. 5) thereby allowing communication between aperture 13 and bag 20. Flange 24 is cylindrically shaped and may have a length of approximately three-quarters of an inch and an outside diameter of approximately four and one-half inches. Bag mouth 25 is positioned over flange 24 and retaining ring 11 is then slipped over bag 20 onto flange 24 whereby mouth 25 is sandwiched between retaining ring 11 and flange 24. Flange 24 includes a plurality of wedge shaped protrusions 26 as seen in FIG. 4 whereby retaining ring 11 includes a comparable number of matching slots 27. As would be understood, retaining ring 11 slides over flange 24 with protrusions 26 aligned to pass through slots 27. Thereafter retaining ring 11 is rotated either clockwise or counterclockwise which locks ring 11 onto flange 24 with bag mouth 25 therebetween and securely positioned with ring 11 supported on protrusion 26 for receiving liquids, tools, throw-away gloves, bandages, tubing or other materials for disposal purposes. Also, during certain procedures, bag 20 may be used to hold tools or instruments in a sterile environment during use.

Once bag 20 which may have a capacity of one-half gallon has been secured on bag retaining device 10, it is ready for positioning under a mattress for convenient bedside use. As seen in FIG. 5, flexible bag retaining device 10 is positioned between mattress 28 and box spring 29. Gripping means 14 helps maintain retaining device 10 in a secure position against mattress 28 or other surface and prevents it from being accidentally dislodged as by inadvertently brushing against the same. After use, retaining device 10 can be easily removed, bag 20 replaced and used at the bedside of another patient. In other embodiments of the device bag 20 may be permanently affixed to elongated member 12 whereupon disposal of both after use is made.

The illustrations and examples provided herein are for explanatory purposes and are not intended to limit the scope of the appended claims.

I claim:

1. A bag retaining device comprising: an elongated member, said elongated member defining an aperture, a flange, said flange depending from said elongated member and surrounding said aperture, a retaining ring, said ring positionable on said flange for maintaining the mouth of a flexible bag on said flange and a liquid reservoir, said reservoir positioned on said elongated member proximate said aperture and extending downwardly along said flange.

2. A bag retaining device as claimed in claim 1 and including means to grip a surface, said gripping means affixed to said elongated member.

3. A bag retaining device as claimed in claim 1 and including means to hold a flexible tube, said tube holding means attached to said elongated member.

4. A bag retaining device as claimed in claim 1 and including means to pinch a flexible tube, said tube pinching means attached to said elongated member.

5. A bag retaining device as claimed in claim 1 wherein, said flange is cylindrically shaped.

6. A bag retaining device and bag in combination comprising:

a flexible bag having an open mouth; and a bag retaining device comprising: an elongated member, said elongated member defining an aperture at one end thereof, means to grip a mattress, said gripping means attached to the opposite end of said elongated member, a flange, said flange depending from said elongated member, said flange surrounding said aperture;

said bag mouth engaging said flange;

a retaining ring, said ring slidable over said flange with said bag thereon to maintain said bag on said flange, a liquid reservoir, said reservoir positioned on said elongated member proximate said aperture and extending downwardly along said flange.

7. The combination of claim 6 wherein said elongated member is formed from a rigid plastic.

8. The combination of claim 6 wherein said bag comprises a flexible plastic bag.

9. The combination of claim 6 wherein said retaining ring is formed from a rigid plastic.

* * * * *